US005867801A

United States Patent [19]

Denny

[11] Patent Number: 5,867,801

[45] Date of Patent: Feb. 2, 1999

[54] REMOTE ASSET MONITORING SYSTEM

[75] Inventor: Joseph M. Denny, Fairport, N.Y.

[73] Assignee: General Railway Signal Corporation, Rochester, N.Y.

[21] Appl. No.: 585,917

[22] Filed: Jan. 11, 1996

[51] Int. Cl.[6] ..... G06F 19/00

[52] U.S. Cl. ..... 701/35; 701/19; 246/169 R

[58] Field of Search ..... 701/19, 29, 33, 701/35; 246/167 R, 169 R, 169 D, 169 S; 340/438, 439

[56] References Cited

U.S. PATENT DOCUMENTS

| | | | |
|---|---|---|---|
| 3,377,616 | 4/1968 | Auer, Jr. . | |
| 3,994,459 | 11/1976 | Miller et al. . | |
| 4,041,470 | 8/1977 | Slane et al. | 701/35 |
| 4,104,630 | 8/1978 | Chasek . | |
| 4,160,522 | 7/1979 | Dikinis . | |
| 4,288,689 | 9/1981 | Lemelson et al. . | |
| 4,471,343 | 9/1984 | Lemelson . | |
| 4,783,028 | 11/1988 | Olson . | |
| 4,804,937 | 2/1989 | Barbiaux et al. | 701/35 |
| 4,977,577 | 12/1990 | Arthur et al. . | |
| 4,995,053 | 2/1991 | Simpson et al. . | |
| 5,058,044 | 10/1991 | Stewart et al. | 701/35 |
| 5,185,700 | 2/1993 | Bezos et al. | 701/35 |
| 5,445,347 | 8/1995 | Ng . | |
| 5,450,321 | 9/1995 | Crane | 701/35 |
| 5,657,224 | 8/1997 | Lonn et al. | 701/35 |

OTHER PUBLICATIONS

Article entitled A Low Cost CDMA Transmitter Using the AX602 ASIC, Microcontroller and Minimal RF Circuitry by David J. Beal and Gerard J. Hill dated Feb. 1995 as appeared in RF Design, pp. 26–32.

*Primary Examiner*—Gary Chin
*Attorney, Agent, or Firm*—Ohlandt, Greeley, Ruggiero & Perle

[57] ABSTRACT

There is provided a vehicle tracking and monitoring system for monitoring railway cars within a defined radius of a receiver for wireless communication. The system comprises a transmitter on-board each railway car, a receiver at a wayside station, and a central database at a remote location. The transmitter includes an RF circuit, an I/O circuit and a microcontroller for autonomously and spontaneously transmitting vehicle signals on a cyclic basis to the receiver. The transmitter periodically transmits railway car information and/or cargo status information to the receiver within a predetermined time interval, for example, every 15 minutes. In addition, the transmitted information is communicated from the wayside station to the central database over a longer time interval, fore example, every 24 hours. Accordingly, the central database develops a record of transit vehicle information based on the transmitted information for each transit vehicle in the defined radius of the receiver.

19 Claims, 5 Drawing Sheets

REMOTE ASSET MONITORING SYSTEM

BACKGROUND OF THE INVENTION

I. Field of the Invention

The present invention relates generally to systems for tracking and monitoring transportation vehicles. More particularly, the present invention relates to a system for precisely locating and monitoring railway cars within a predetermined radius of a receiver for wireless communication.

II. Description of the Prior Art

Systems for tracking and monitoring railway cars are generally known. For example, U.S. Pat. No. 3,377,616 to J. H. Auer, which issued on Apr. 9, 1968, entitled VEHICLE IDENTIFICATION SYSTEM provides a railway car identification system in which a transducer device is mounted to a railway car. The transducer device has an electrical signal generating circuit that is rendered effective when the transducer is exposed to a light beam from a wayside station. The transducer then radiates a signal that includes a vehicle identification code of the railway car to a receiving device of the wayside station.

Similar to U.S. Pat. No. 3,377,616 above, U.S. Pat. No. 4,160,522 to D. V. Dikinis, which issued on Jul. 10, 1979, entitled AUTOMATIC CAR IDENTIFICATION SYSTEM describes another railway car identification system in which light signals are received from and transmitted to a wayside station. This patent provides a light beam-based system in which an identification label having vertical, light re-transmitting columns is attached to the side of a railway car. Each column of the identification label represents a digital number. As the railway car passes a wayside station, a light transmitter of the wayside station transmits a light beam at the identification label and a light receiver of the wayside station receives a light signal from the identification label. The light receiver then decodes the light signal and transmits all pertinent information to other data processing equipment at a remote location.

In addition to light signals, wireless signals or communication may also be used to transmit railway car identification information between a railway car and a wayside station. Such wireless communication includes radio frequency, microwave, satellite link and spread spectrum technologies. For example, U.S. Pat. No. 4,104,630 to N. E. Chasek, which issued on Aug. 1, 1978, entitled VEHICLE IDENTIFICATION SYSTEM USING MICROWAVES, provides a microwave-based system in which an identification panel is attached to the side of a railway car. To identify the railway car, a microwave signal emitted from an interrogating transmitter of a wayside station is reflected by the identification panel as a doppler offset signal. Thus, the wayside station will register that a railway car when an identification panel has passed. Also, U.S. Pat. No. 5,445,347 to J. S. Ng, which issued on Aug. 29, 1995, entitled AUTOMATED WIRELESS PREVENTIVE MAINTENANCE MONITORING SYSTEM FOR MAGNETIC LEVITATION (MAGLEV) TRAINS AND OTHER VEHICLES provides an automated maintenance system for a MAGLEV train. Each car of the MAGLEV train includes a status unit which monitor the operational status or condition of the car. Network units at wayside stations transmit control signals which poll the status units and cause them to transmit data signals via a spread-spectrum time-division-multiple-access network. The network units relay the data signal to a maintenance control center via a wide-area-network.

Thus, the above patents provide systems for monitoring railway vehicles in which each vehicle must have vehicle transmitters and vehicle receivers in order for the system to operate properly. In particular, the vehicle transmitters are necessary to transmit vehicle identification signals to wayside receivers at local wayside stations, and the vehicle receivers are necessary to identify a local wayside station and determine when the vehicle transmitters should transmit such signals. Therefore, the cost of manufacturing, installing and maintaining the systems described in the above patents must include the such costs for both the transmitter and the receiver for each transit vehicle. In addition, each transit vehicle must have enough power to maintain the energy requirements of both the transmitter and the receiver.

The present invention provides an efficient and cost effective system for monitoring transit vehicles within a defined area of a wayside receiver. For the present invention, each transit vehicle has a vehicle transmitter but does not require a vehicle receiver. In particular, the vehicle transmitter sends vehicle information, such as transmitter specific parameters and status conditions of cargo, without regard to whether a wayside receiver is nearby. When the vehicle comes within range of a wayside receiver, the wayside receiver will periodically receive vehicle information from the vehicle transmitter and forward such information to a central database. Accordingly, the cost of manufacturing, installing and maintaining a vehicle receiver and the energy requirements for maintaining such vehicle receiver are no longer needed.

SUMMARY OF THE INVENTION

Against the foregoing background, it is a primary object of the present invention to provide a vehicle monitoring system for monitoring a plurality of transit vehicles that operates efficiently and accurately without the need for a vehicle receiver in each transit vehicle.

It is another object of the present invention to provide such a vehicle monitoring system in which each transit vehicle has a transmitter for periodically transmitting vehicle signals without regard to whether a wayside receiver is within its transmitting range.

It is a further object of the present invention to provide such a transmitter for a vehicle monitoring system which utilizes spread spectrum technology for low power consumption and, thus, precludes interference among transmitted signals and extends the life of its power source.

It is still further object of the present invention to provide such a transmitter for a vehicle monitoring system in which the vehicles signals transmitted by each vehicle transmitter includes transmitter specific parameters, such as identification of particular vehicles, as well as status conditions of cargo.

It is still another object of the present invention to provide a vehicle monitoring system in which each wayside station has a wayside receiver to detect vehicle signals transmitted by various transit vehicles.

It is yet another object of the present invention to provide such a vehicle monitoring system in which a central database is linked to each wayside receiver via leased lines to provide quick and efficient access of vehicle information to anyone accessing the central database.

To accomplish the foregoing objects and advantages, the present invention, in brief summary, is a vehicle monitoring system for monitoring a plurality of transit vehicles located within a defined area which comprises a transmitter for each transit vehicle and at least one receiver. Each transmitter is located on each of the plurality of transit vehicles and transmits a plurality of vehicle signals from each transit vehicle. Also, each transmitter includes means for generating the plurality of vehicle signals and autonomous means for spontaneously transmitting the plurality of vehicle signals on a cyclic basis over an extended time period. In addition, at least one receiver is located within the defined area for receiving at least one vehicle signal from each transit vehicle and includes means for determining vehicle data for each transit vehicle based on the at least one vehicle signal and means for storing the vehicle data for the plurality of transit vehicles to form a group of vehicle data. Further, the vehicle monitoring system includes means for processing the group of vehicle data and developing a record of transit vehicle information for each transit vehicle in the defined area, such as a time/date stamp of each vehicle entering and/or leaving the defined area.

DESCRIPTION OF THE DRAWINGS

The foregoing and still further objects and advantages of the present invention will be more apparent from the following detailed explanation of the preferred embodiments of the invention in connection with the accompanying drawings.

DETAILED DESCRIPTION OF THE PREFERRED EMBODIMENT

Figure 1:
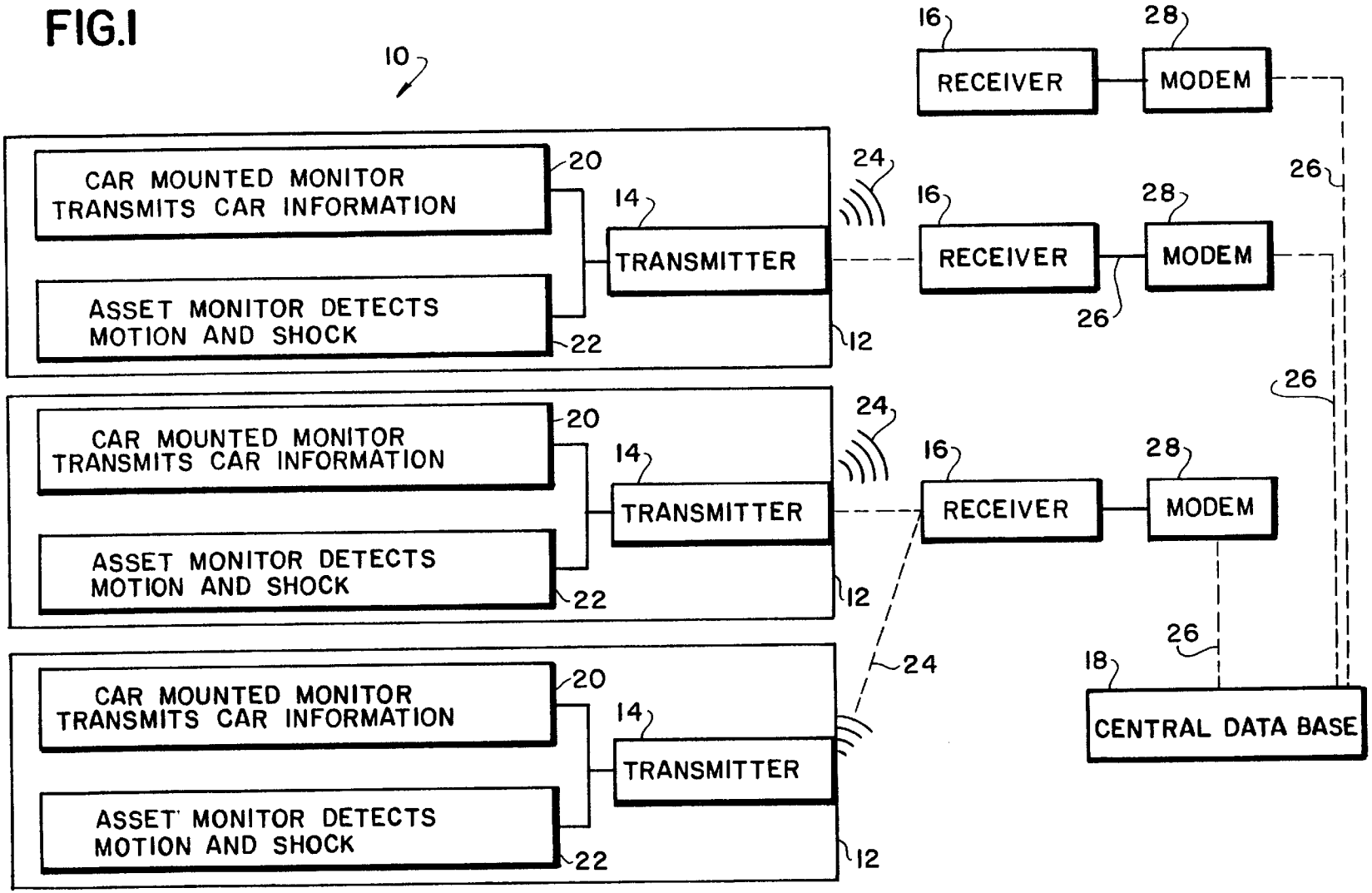
FIG. 1 is a block diagram of the vehicle monitoring system of the present invention.

Referring to the drawings and, in particular, to FIG. 1, there is provided a remote vehicle monitoring system of the preferred embodiment which is generally represented by reference numeral 10. The vehicle monitoring system 10 monitors a plurality of transit vehicles 12, such as railway cars, located within a defined area. In particular, the vehicle monitoring system 10 comprises a transmitter 14 on each transit vehicle 12, one or more receivers 16 located in the defined area, a central database 18 that is linked to the receiver or receivers. The defined area covers the area around each receiver 16 that is within maximum receiving range of transmitted signals from the transmitters 14. For an area having a single receiver 16, by way of example, the defined area may have a circular boundary that is defined by a radius of about 3 to 10 miles from the receiver depending upon the type of antenna used.

Figure 2:
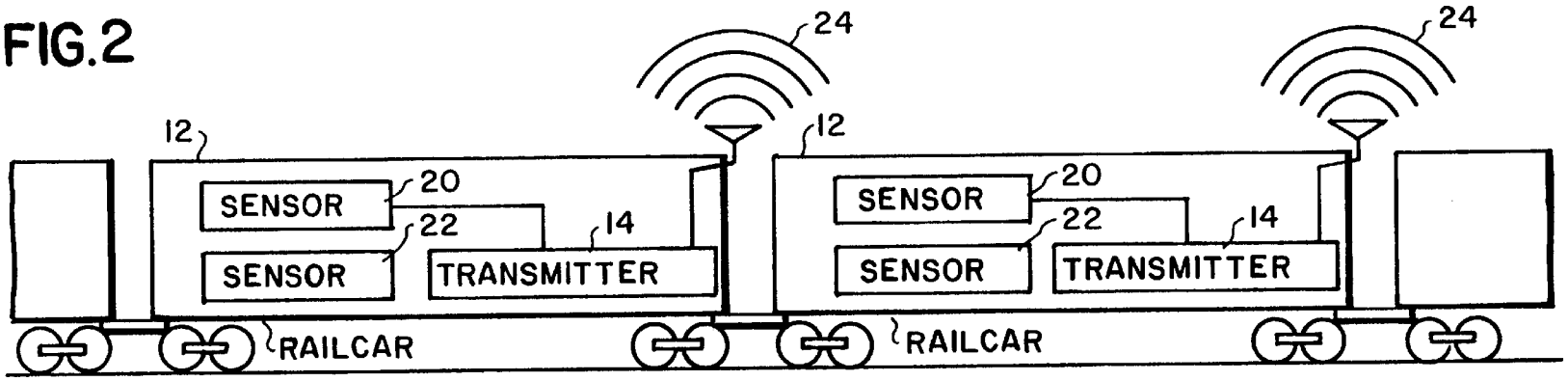
FIG. 2 is a diagrammatic view of a plurality of railway cars having the transmitter of FIG. 1.

Referring to FIGS. 1 and 2, each transit vehicle 12 includes a wireless transmitter 14 for transmitting basic parameters such as vehicle identification data, vehicle family data, transmitter type, chipping sequence selection, supervisory transmission period and alarm parameters. In addition, each transit vehicle 12 may includes a vehicle sensor 20 for detecting vehicle conditions and an asset sensor 22 for detecting asset conditions. The vehicle sensor 20 detects information regarding the status of the transit vehicle 12, such as vehicle loaded/unloaded status data, vehicle location data, vehicle motion data, vehicle shock data and vehicle supervisory data. Similarly, the asset sensor 22 detects information regarding the status of the transit vehicle's cargo such as asset identification data, asset motion data, asset shock data and asset supervisory data. In addition, each transmitter may transmit a particular event signal, responsive to vehicle entry, vehicle departure, asset entry or asset departure, to a receiver and trigger a time clock at the receiver that generates a time stamp, such as a time stamp of vehicle and/or asset entry into and departure from the defined area.

Each transmitter 14 periodically transmits vehicle signals 24, automatically and spontaneously, on a cyclic basis over an extended period of time. For transit vehicles 12 within the defined area, vehicle signals 24 will be received by one or more receivers 16 in the defined area. Each receiver 16 determines vehicle data for each transit vehicle 12 based on the vehicle signals 24 and stores the vehicle data over a predetermined time period to form a data group. The data group includes vehicle data for each transit 12 in the defined area. At the end of each interval of the predetermined time period, the receiver 16 sends the data group to the central database 18 which process the data group and develops a record of transit vehicle information for each transit vehicle 12 in the defined area.

In addition, two or more receivers 16 may be situated in a defined area to pinpoint the exact location of a transit vehicle 12. The location of a transmit vehicle 12 may be identified by comparing vehicle signals 24 received at two or more distally positioned receivers 16 and triangulating the position of the transit vehicle based on those received signals. For example, the received signals may be received by the receivers 16 at different times and, thus, the location of the transit vehicle 12 may be identified by comparing this difference in time.

In the event that two or more vehicle signals 24 are received by a single receiver 16 within the same time frame, the receiver will postpone identification of at least one vehicle signal. The transmitter 14 includes circuitry to dither the cyclic basis of its transmissions whereby the vehicle signals 24 are transmitted at varying time intervals. Accordingly, the receiver 16 will expect similar vehicle signals 24 to be re-transmitted by their respective transmitters 14 at different time frames and will identify the vehicle signals at that time.

For the preferred embodiment, the transmitter 14 has a basic coding circuit that incorporates spread spectrum technology to broadcast modulated spread spectrum signals and includes an address means for identification, preamble means and data means. Likewise, the receiver 16 has a decoding circuit that demodulates the spread spectrum signals collected from a polar diversity antenna and filters out undesirable frequencies. The spread spectrum technology precludes interference among signals and minimizes the power consumption of the transmitter 14 to extend the life of its power source. Also, the receiver 16 compares and synchronizes desirable frequencies to a spread spectrum code of interest, thereby extracting the original vehicle signals 24. It is to be understood that the present invention may utilize a wide variety of different spread spectrum transmitters and receivers. Preferably, such transmitters and receivers are set forth in U.S. Pat. No. 4,977,577, which issued on Dec. 11, 1990 and is incorporated herein by reference.

The transmitter 14 transmits vehicle signals 24 at a particular frequency on a cyclic basis based on a predetermined time interval, and the receiver 16 stores the vehicle data over a predetermined time period. For example, the preferred transmitter 14 transmits the vehicle signals 24 about one transmission every 15 minutes, and the preferred receiver 16 stores the vehicle data about 24 hours or on exception basis. Preferably, the vehicle signals 24 are transmitted from the transmitters at a common carrier frequency such that any one of the receivers 16 may receive the vehicle signals at that frequency. In addition, the central database 18 is linked to the receivers 16 via a variety of communications links 26, such as land lines, microwave links and satellite links. Preferably, a leased line 26 connects the receivers 16 to the central database 18 in which the receiver has a modem 28 for transmitting the data groups to the central database.

It is important to note that each transit vehicle 12 has a transmitter 14 for sending periodic transmissions regardless of whether a receiver 16 is within receiving range. In addition, the vehicle monitoring system 10 of the present invention operates fully without the need for a receiver at the transit vehicles 12. The transmitter 14 is capable of operating in this mode for an to extended period of time due to the controlled, periodic intervals of the transmissions and the spread spectrum technology implemented into the circuitry of the transmitter.

Figure 3:
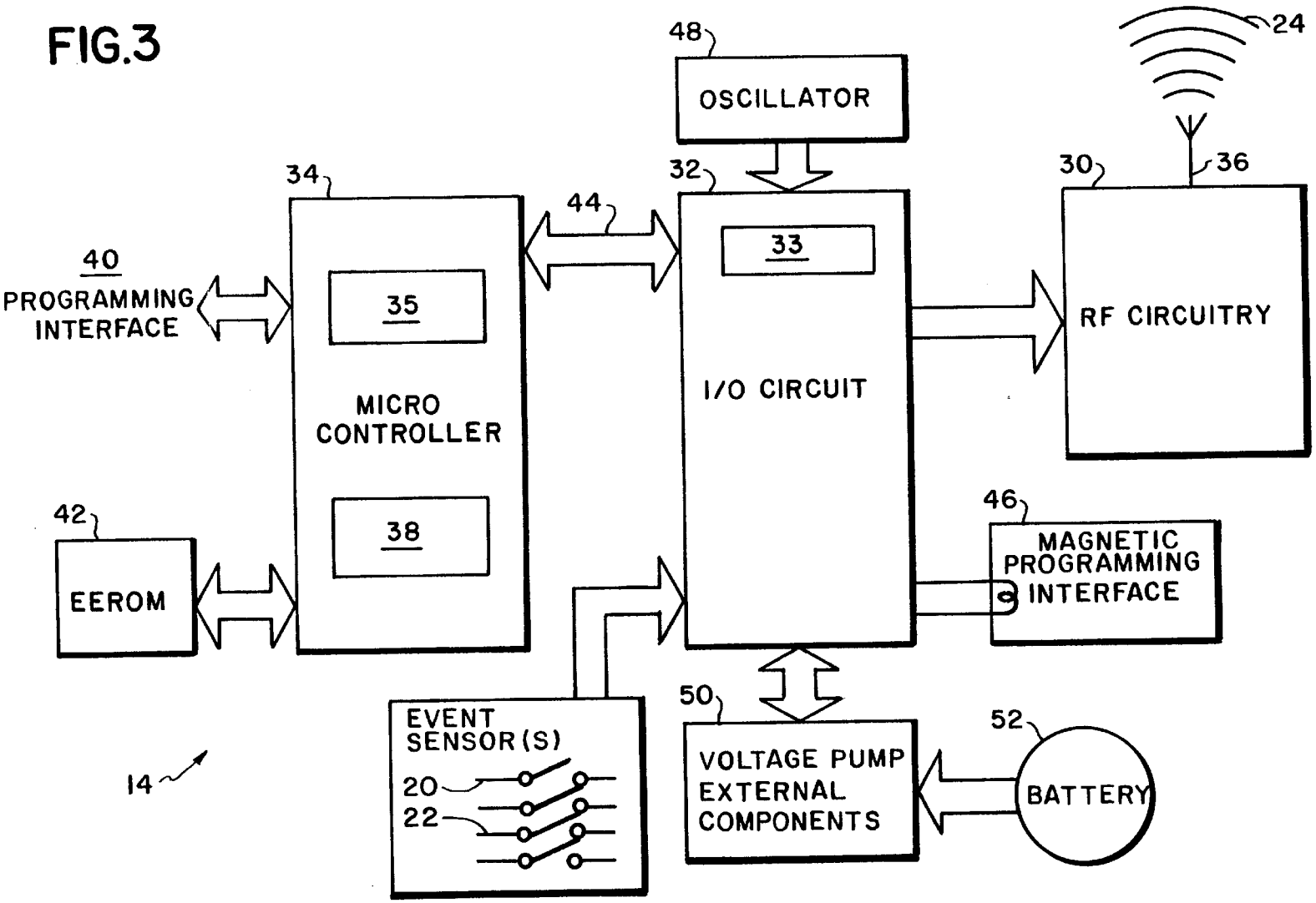
FIG. 3 is block diagram of the transmitter of FIG. 1.

Referring to FIG. 3, the transmitter includes an RF circuit 30, an I/O circuit 32 and a microcontroller 34. The RF circuit 30 transmits vehicle signals 24 via an antenna 36 based on RF output signals received from the I/O circuit 32. The I/O circuit 32 generates the RF output signal to drive the RF circuit 30 based on operational instructions received from the microcontroller 34. The microcontroller 34 has internal random access memory (RAM) 38 that may be programmed directly by a programming device (not shown), such as a personal computer, via a programming interface 40. Also, the microcontroller 34 may be coupled to an external EEROM 42 for storage of data which is particularly useful in the event of a power failure. Further, the I/O circuit 32 may be programmed through either a direct serial input connection 44 via the microcontroller 34 or through a magnetic programming interface 46. The internal RAM 38, external EEROM 42 and/or I/O circuit 32 of the transmitter 14 may be programmed with basic or transmitter specific parameters such as vehicle identification data, vehicle family data, transmitter type, chipping sequence selection, supervisory transmission period and alarm parameters, as well as necessary transmitter instructions. Thus, the vehicle signals 24 transmitted by the RF circuitry 30 are easily controlled and determined by simply programming the microcontroller 34 and/or the I/O circuit 32.

Also, the I/O circuit 32 is connected to an oscillator 48, one or more sensors 20 & 22, and a voltage converter or pump 50 connected to a power source 52. The oscillator 48 provides the I/O circuit 32 with timing signals, and the I/O circuit 32 may either relay these timing signals to the microcontroller 34 or generate a sub-multiple of the timing signals for the microcontroller. Thus, the microcontroller 34 and/or the I/O circuit 32 include timing means 33 & 35 for initiating transmittal of the vehicle signals 24 on a cyclic basis. In addition, each sensor 20 & 22 that is coupled to the transmitter 14 is connected to the I/O circuit 32 and the voltage pump 50 is an onboard DC to DC converter control circuit. The voltage pump 50 is used to provide external components, such as the microcontroller 34, the RF circuitry 30 and the sensors 20 & 22, with regulated voltage. In the event that the I/O circuit 32 detects that the energy level from the voltage pump 50 is below a certain threshold value, the I/O circuit will send a low voltage message during the next transmission to the receiver 16 (shown in FIG. 1). Further, the I/O circuit 32 of the transmitter 14 includes circuitry to dither the cyclic basis of the transmitter whereby the vehicle signals 24 are transmitted at varying time intervals.

It is to be understood that the transmitter 14 of the present invention may utilize any type of I/O circuit 32 that performs the functions described above. For example, one such I/O circuit is set forth in an article titled "A Low Cost CDMA Transmitter Using the AX0602 ASIC, Microcontroller and Minimal RF Circuit", *RF Design* (Feb. 1995) pp. 26 through 32, which is incorporated herein by reference.

Figure 4:
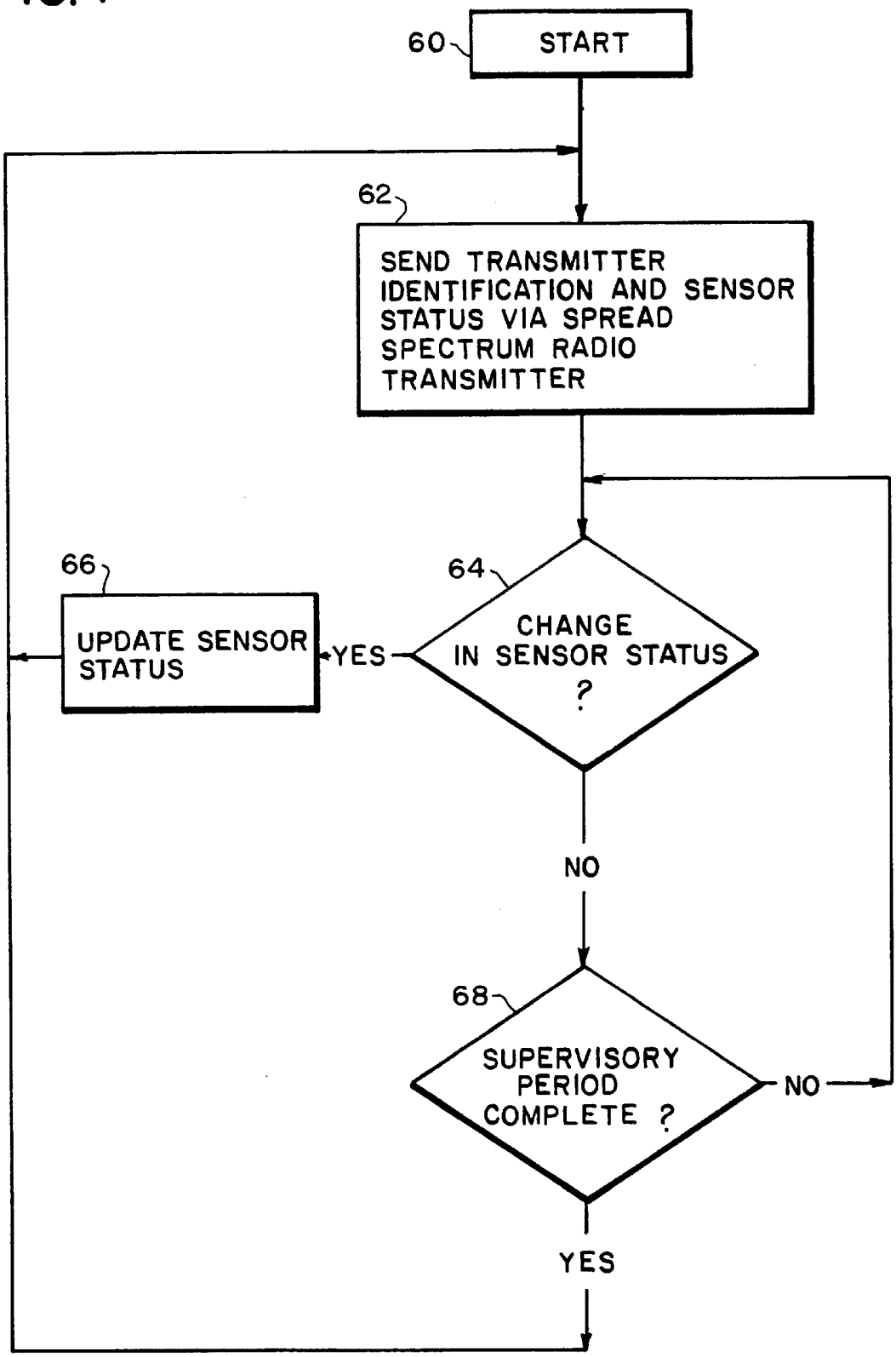
FIG. 4 is a flow diagram of the operation of the transmitter of FIG. 3.

Referring to FIGS. 3 and 4, the internal RAM 38 and/or external EEROM 42 of the transmitter 14 is programmed so that the transmitter will perform certain functions, starting at step 60. In particular, as shown by step 62, the microcontroller 34 instructs the I/O circuit 32 and RF circuitry 30 to send transmitter identification, sensor status and other information via spread spectrum frequencies. As shown by step 64, the microcontroller 34 then determines whether the I/O circuit 32 has identified a change in status for any of the sensors 20 & 22. If the status of one or more sensors 20 & 22 has changed, the sensor status data is updated as shown by step 66 and the I/O circuit and RF circuitry 30 are instructed to send another transmission as shown by step 62. Otherwise, the microcontroller 34 will determine whether the supervisory period, which corresponds to the predetermined time interval of the transmitter 14, is complete as shown by step 68. If not, the microcontroller 34 will simply check the status of the sensors 20 & 22 again as shown by step 64. However, if the supervisory period is complete, then the microcontroller 34 will instruct the I/O circuit 32 and RF circuitry 30 to send the next transmission as shown by step 62.

Figure 5:
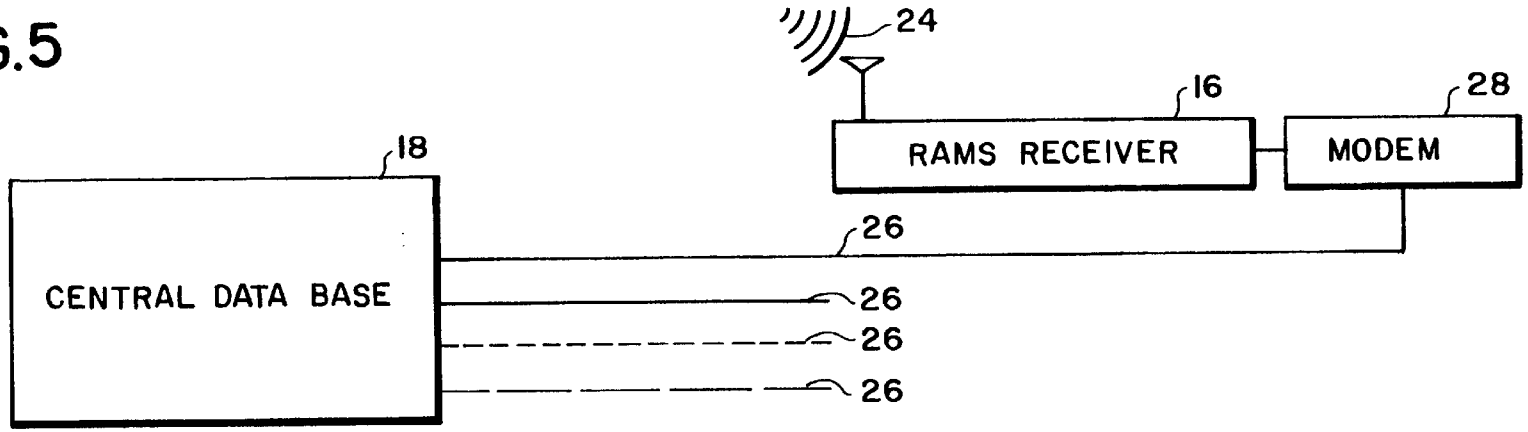
FIG. 5 is a block diagram of the receiver, modem and central database of FIG. 1.

Referring to FIG. 5, the receiver 16 sends a data group to a central database 18 once every predetermined time period. As stated above, each data group may be transmitted in a wide variety of communication means 26, including land lines, microwave links and satellite links. For the preferred embodiment shown in FIG. 5, each receiver is connected to modem 28 for serial data transfer to the central database 18. Thereafter, the central database 18 processes the data group and develops a record of transit vehicle information for each transit vehicle 12 (shown in FIG. 2) in the defined area.

Figure 6:
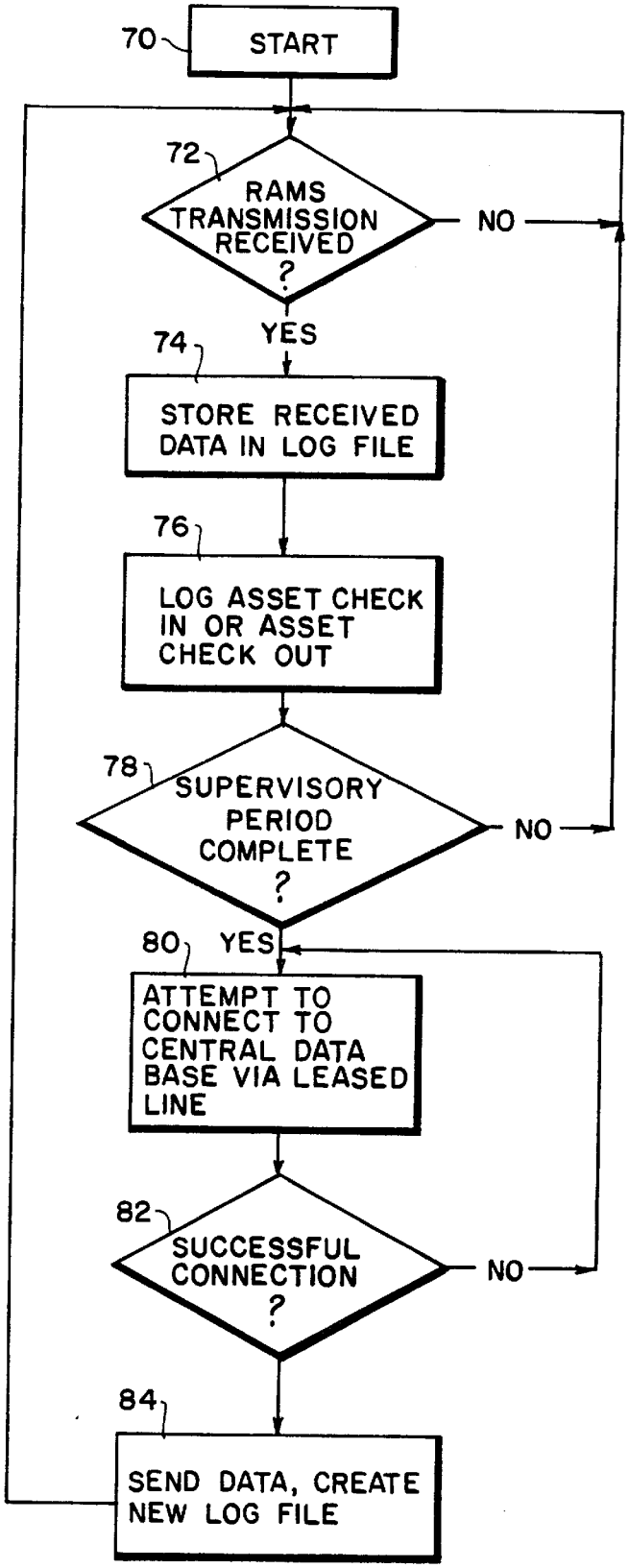
FIG. 6 is a flow diagram of the operation of the receiver of FIG. 5.

Referring to FIGS. 5 and 6, the operation of each receiver 16 for receiving vehicle signals 24 from a plurality of transit vehicles 12 (shown in FIG. 2) and for sending data groups of the vehicle signals to the central database 18 is provided, starting with step 70. It is to be understood that existing wireless receivers having a programmable microprocessor and an internal memory portion may be used for the present invention, such as the receiver set forth in U.S. Pat. No. 4,977,577, cited above. In particular, as shown in step 72, the receiver 16 determines whether a vehicle signal 24 has been received from the transmitter 14 and will wait until such vehicle signal has been received. Once a vehicle signal 24 is received, the receiver 16 stores the vehicle signal 24 in a log file to form a group of vehicle data, as shown by step 76, and logs the status of the asset or cargo of the transmitting transit vehicle 12, as shown by step 76. The receiver 16 then determines whether the supervisory period is complete, as shown in step 78. If not, the receiver 16 will again wait for the a vehicle signal 24 to be received, as shown in step 72. However, if the supervisory period is complete, the receiver 16 will attempt to connect to the central database 18 via leased line 26 as shown in step 80 and will continue the connection attempt until successful as shown in step 82. Thereafter, the receiver 16 sends the group of vehicle data, collected during the predetermined time period, to the central database 18 and creates a new log file as shown in step 84 and awaits a vehicle signal 24 to be received once again as shown in step 72.

The present invention may be used for tracking a wide variety of information for transit vehicles. For example, the system may be used to track a particular railway car for its owner. In particular, when a shipper utilizes the railway car, the owner will be able to accurately bill the shipper for use of the railway car. In another example, the transit vehicle may be loaded with tamper detection devices to monitor the vehicle for security purposes. If the asset or cargo hold of the transit vehicle is prematurely opened, the transmitter of the transit vehicle will send a warning message to the receiver which, thus, updates the central database.

Also, the above described modular design of the present invention provides for quick and simple interfacing of a variety of sensors. In particular, the transmitter is capable of interfacing with several add-on sensors at the option of the user. To interface these sensors, each sensor is simply connected to the I/O circuit and the microcontroller is simply programmed to recognize the added sensor. Accordingly, such enhancement and customization of the core system is facilitated by the modular design of the present invention.

In addition, as described above, triangulation may be used to locate the position of each transit vehicle. In particular, each transmitter may transmit data as part of its vehicle signal so that two or more synchronized receivers at disparate locations may receive the vehicle signal. Then, an analyzing means, such as the central database, may compare the timing of received vehicle signals to triangulate and identify the position of the transit vehicle.

The invention having been thus described with particular reference to the preferred forms thereof, it will be obvious that various changes and modifications may be made therein without departing from the spirit and scope of the invention as defined in the appended claims.

Wherefore, I claim:

1. A vehicle monitoring system for monitoring a plurality of transit vehicles located within a defined area comprising:

a transmitter on each of the plurality of transit vehicles for transmitting a plurality of vehicle signals, representing the status of vehicle and cargo, from each transit vehicle, said transmitter including means for generating said plurality of vehicle signals and autonomous means, which is operative absent any receiver on the vehicle, for spontaneously transmitting said plurality of vehicle signals on a cyclic basis over an extended time period;

at least one receiver located within the defined area for receiving at least one vehicle signal from each transit vehicle, said at least one receiver including means for determining vehicle data for each transit vehicle based on said at least one vehicle signal and means for storing said vehicle data for said plurality of transit vehicles to form a group of vehicle data; and means for processing said group of vehicle data and developing a record of transit vehicle information for each transit vehicle in the defined area.

2. The vehicle monitoring system of claim 1, wherein said plurality of vehicle signals are transmitted from all of said transmitters at a common carrier frequency.

3. The vehicle monitoring system of claim 1, wherein said transmitter includes timing means for initiating transmittal of each of said plurality of vehicle signals on said cyclic basis.

4. The vehicle monitoring system of claim 1, wherein said transmitter includes means for dithering said cyclic basis whereby said plurality of vehicle signals is transmitted at varying time intervals.

5. The vehicle monitoring system of claim 4, wherein said at least one receiver includes means for postponing identification of said vehicle signal when at least two of said plurality of vehicle signals are received by said at least one receiver within a same time frame.

6. The vehicle monitoring system of claim 1, further comprising at least one sensor on each of the plurality of transit vehicles for detecting an asset condition for its respective transit vehicle.

7. The vehicle monitoring system of claim 6, wherein said asset condition includes at least one type of data from the group consisting of: asset identification data, time stamp of asset entry into the defined area, time stamp of asset departure from the defined area, asset motion data, asset shock data and asset supervisory data.

8. The vehicle monitoring system of claim 1, wherein said transmitter is a spread spectrum transmitter that incorporates a coding means for producing modulated spread spectrum signals to be broadcast.

9. The vehicle monitoring system of claim 1, wherein said transmitter includes an RF circuit for transmitting said plurality of vehicle signals, an I/O circuit for generating an RF output signal to drive said RF circuit.

10. The vehicle monitoring system of claim 9, further comprising at least one sensor on each of the plurality of transit vehicles for detecting a status condition for its respective transit vehicle, wherein said at least one sensor is coupled to said I/O circuit.

11. The vehicle monitoring system of claim 9, wherein said transmitter includes a controller, coupled to said I/O circuit, having a internal memory portion for storing transmitter specific parameters, wherein said controller provides said I/O circuit with operational instructions based on said transmitter specific parameters.

12. The vehicle monitoring system of claim 11, wherein said transmitter specific parameters includes at least one type of data from the group consisting of: vehicle identification data, vehicle family data, transmitter type, chipping sequence selection, supervisory transmission period and alarm parameters.

13. The vehicle monitoring system of claim 1, further comprising at least one sensor on each of the plurality of transit vehicles for detecting a vehicle condition for its respective transit vehicle.

14. The vehicle monitoring system of claim 13, wherein said vehicle condition includes at least one type of data from the group consisting of: time stamp of vehicle entry into the defined area, time stamp of vehicle departure from the defined area, vehicle loaded/unloaded status data, vehicle location data, vehicle motion data, vehicle shock data and vehicle supervisory data.

15. The vehicle monitoring system of claim 1, wherein said cyclic basis has a predetermined time interval of about one transmission every 15 minutes.

16. The vehicle monitoring system of claim 1, wherein said storing means of said at least one receiver forms said group of vehicle data by storing said vehicle data over a predetermined time period.

17. The vehicle monitoring system of claim 1, wherein said predetermined time period of stored vehicle signals is about 24 hours.

18. The vehicle monitoring system of claim 1, wherein said processing means is a central database linked to said at least one receiver for receiving and storing said group of vehicle data and for determining a presence of each transit vehicle in the defined area, whereby said record of said transit vehicle information is developed by said central database.

19. The vehicle monitoring system of claim 1, wherein said central database is coupled to said at least one receiver by a leased line, and said at least one receiver includes a modem for transmitting said group of vehicle data via said leased line.

* * * * *